US005332393A

United States Patent [19]

Gödl

[11] Patent Number: 5,332,393

[45] Date of Patent: Jul. 26, 1994

[54] VENTILATOR CAP

[75] Inventor: Fritz Gödl, Ennetborgen, Switzerland

[73] Assignee: Norm A.M.C. AG, Erstfeld, Switzerland

[21] Appl. No.: 105,965

[22] Filed: Aug. 13, 1993

[30] Foreign Application Priority Data

Aug. 13, 1992 [DE] Fed. Rep. of Germany ..... 4226817

[51] Int. Cl.[5] ..... F24F 7/02

[52] U.S. Cl. ..... 454/365; 52/57; 52/199

[58] Field of Search ..... 52/57, 199; 454/364, 454/365, 366, 367

[56] References Cited

U.S. PATENT DOCUMENTS 4,558,637 12/1985 Mason ..... 454/365

FOREIGN PATENT DOCUMENTS 7118474 12/1971 Fed. Rep. of Germany .

288020 10/1988 Fed. Rep. of Germany ..... 454/365

8913744 4/1990 Fed. Rep. of Germany .

8816544 11/1990 Fed. Rep. of Germany .

1253835 11/1971 United Kingdom ..... 52/57

*Primary Examiner*—Harold Joyce

[57] ABSTRACT

A ventilator cap (1), made of plastic, for ventilation of roofs in the ridge, hip or arris area, with a fastening area (2), with an edge area (3) and with an intermediate area (4) connecting the fastening area (2) and the edge area (3) with one another, in which intermediate area has air passage openings (5, 6) and edge area (3) has an elastically flexible sealing element (7) extending over the length of the cap on its roof-facing underside, and the sealing element (7) has the structure of a fine-fiber brush with a carrier part (8) and a plurality of elastic brush fibers (9) placed in at least as flowtight a packing as possible. The effect of the weather conditions on the brush fibers (9) is substantially eliminated, specifically, by placing at least one protective element (10) that influences the elasticity of the brush fibers (9) as little as possible on the outside of sealing element (7), i.e. on the side facing away from the roof.

20 Claims, 3 Drawing Sheets

VENTILATOR CAP

BACKGROUND OF THE INVENTION

1. Field of the Invention

The invention relates to a ventilator cap, preferably made of plastic, for ventilation of roofs in the ridge, hip or arris area, with a fastening area, with an edge area and with an intermediate area connecting the fastening area and the edge area with one another, in which the intermediate area exhibits air passage openings and the edge area exhibits, on the roof side, an elastically flexible sealing element extending over the length of the cap, and the sealing element has the structure of a fine-fiber brush with a carrier part and a plurality of elastic brush fibers arranged in a packing that is at least as flowtight as possible.

2. Description of Related Art

Ventilator caps of the above-mentioned type for ventilation of roofs have been known for quite a long time. For better ventilation of a roof cover, ventilator caps are placed in the ridge area of a roof to avoid possible damage from moisture formation. Ventilated roof covers generally have an inside shell, an outside shell and a ventilated roofing space. While the inside shell is basically used only for thermal insulation, the outside shell of the ventilated roof cover provides protection against weather. The outside shell must be able to deflect the precipitate moisture in a ridge-to-gutter direction, and is subject to especially extensive stresses caused by temperature. The ventilated space separates the inside and outside shells and is used to dissipate the construction moisture and the use moisture. The ventilation of the roofing space is, i.a., dependent on the cross section and the shape of the air gap, the cross section and the shape of the air openings, and the flow-impeding design components in the gap. The air entry or air exit openings for such a roof cover are generally provided in the gutter and ridge area.

Ventilator caps of the type placed in the ridge area assure a good ventilation of the roofing space and the dissipation of moisture. However, the placement of ventilator caps in the ridge area of a roof is problematical, since the air openings or air gaps existing in the ridge area between the ventilator cap and the roof cover have to be sectioned off in a watertight and snowtight manner, and the gaps to be sectioned off in the ridge area exhibit pronounced interval differences and sharp-edged transitions.

From German Gebrauchsmuster (Utility Model) DE-GM 89 13 744, which served as the starting point for the invention, ventilator caps are known that have sealing elements, placed on their edge area, in the form of fine-fiber brushes. The fine-fiber brushes have a plurality of elastic brush fibers, placed in at least as flowtight a packing as possible, which adapt without problems to the most varied gap shapes, especially also to sharp-edged transitions. In general, the brush fibers are made of polypropylene or nylon and exhibit a resilience, so that independently of the type of roofing material, the brush fibers lie against the corresponding transitions or against the roofing material.

The successful method of operation, i.e., the tightness of the ventilator caps provided with these sealing elements, diminishes under the continual influence of the weather conditions. The brush fibers exposed to solar radiation, especially UV radiation, and considerable temperature differences, can become embrittled, lose their resilience and break off easily, thereby reducing the packing density, so that the sealing function of such a sealing element, designed as a fine-fiber brush, is no longer sufficiently assured. In this way, rainwater or windborne snow can pass through the fine-fiber brush into the ventilation spaces of the roof cover, by which the moisture within the ventilated roof space increases.

SUMMARY OF THE INVENTION

The primary object of the present invention is, therefore, to configure and to further develop a ventilator cap of the above-described type so that the effect of the weather conditions on the brush fibers, which can cause an inadequate tightness of the sealing element, is eliminated, without omitting the advantages of a sealing element designed as a fine-fiber brush, i.e., the problem-free adaptation to the varying gap shapes and sharp-edged transitions.

This object is achieved, in accordance with preferred embodiments, by placing on the outside of the sealing element, i.e., on the side facing away from the roof, at least one protective element that influences the elasticity of the brush fibers as little as possible. By the arrangement, according to the invention, of a protective element influencing the elasticity of the brush fibers as little as possible on the outside of the sealing element designed as a fine-fiber brush, the brush fibers are protected from strong solar radiation, especially UV radiation, and considerable temperature differences, so that the effect of the weather conditions on the brush fibers is eliminated and the advantage of problem-free adaptation to the varying gap shapes and sharp-edge transitions continues to exist. The protective element influences the elasticity of the brush fibers as little as possible and protects the brush fibers of the sealing element, so that an embrittlement or reduction of the resilience of the brush fibers is avoided, and thus, the advantages of a fine-fiber brush that can be adapted to varying local conditions remain. Preferably, the protective element is designed as a film produced on a polymer base, especially of polyester urethane, that is glued to the outside of the fine-fiber brush.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
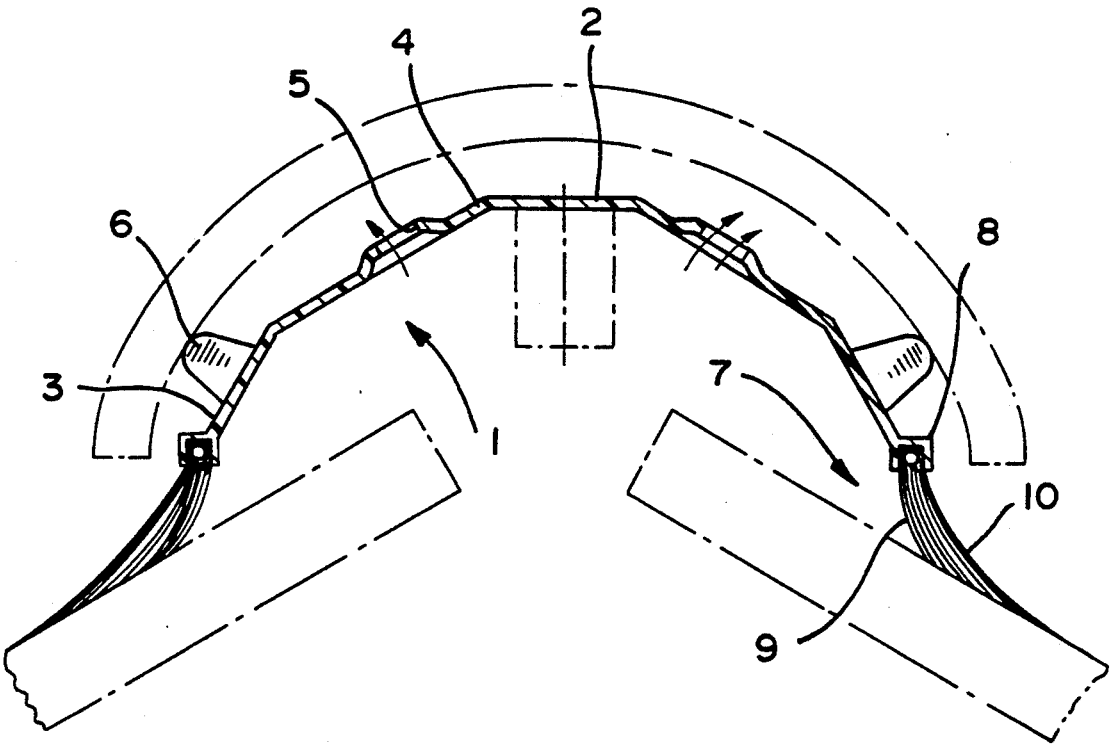
FIG. 1 shows a ventilator cap with sealing elements according to a preferred embodiment of the invention.

FIG. 1 shows a ventilator cap 1 made of plastic for ventilation of the ridge, hip or arris area of a roof. The ridge tile T (which covers the ventilator cap 1 in the ridge area of the roof), the roofing material R running from the ridge to the gutter, as well as the ridge lath L supporting ventilator cap 1 are represented here only in dashed-dotted lines.

Ventilator cap 1 has a fastening area 2, an edge area 3 and an intermediate area 4 connecting the fastening and edge areas with one another. In intermediate area 4, air passage openings 5 are provided for ventilation of the roof and, in edge area 3, supporting elements 6 are provided to brace the ridge tile T. Edge area 3 has an elastically flexible sealing element 7 which extends the length of the cap 1. Sealing element 7 has the structure of a fine-fiber brush with a carrier part 8 and a plurality of elastic brush fibers 9 placed in a packing that is as flow-tight as possible. On the outside of fine-fiber brush or sealing element 7, i.e., on the side facing away from the roof, there is placed a protective element 10 that influences the elasticity of brush fibers 9 as little as possible.

Protective element 10, basically, completely covers the outside of the sealing element 7 along the length of the cap 1. Protective element 10 is deformable and is supported by the brush fibers 9. It can clearly be seen that brush fibers 9 "nestle" against the roofing material R because of their elasticity, which is not influenced by protective element 10.

In the preferred embodiment, protective element 10 is designed as a film. This film is produced on a polymer base, preferably of polyester urethane, and is glued to the outside of sealing element 7, especially "outer" brush fibers 9.

The protective element 10 prevents the penetration of rain and/or snow through brush fibers 9 of sealing element 7. The film produced of a polymer base material, which is used here as protective element 10, exhibits good to very good UV resistance, a high flexibility at low temperatures and a good resistance to heat aging. In this way, brush fibers 9 of sealing element 7 are protected from the effects of weather and the tightness of sealing element 7 increases because of the impermeability of the film to rain and snow.

Films produced on a polymer base, which are used here as protective elements 10, exhibit in particular the following advantageous properties: high mechanical strength, good resistance to oils, fats and many solvents, good corrosion resistance and good weldability according to all usual processes. Such films generally exhibit a thickness of 0.025 to 0.2 mm.

Figure 2:
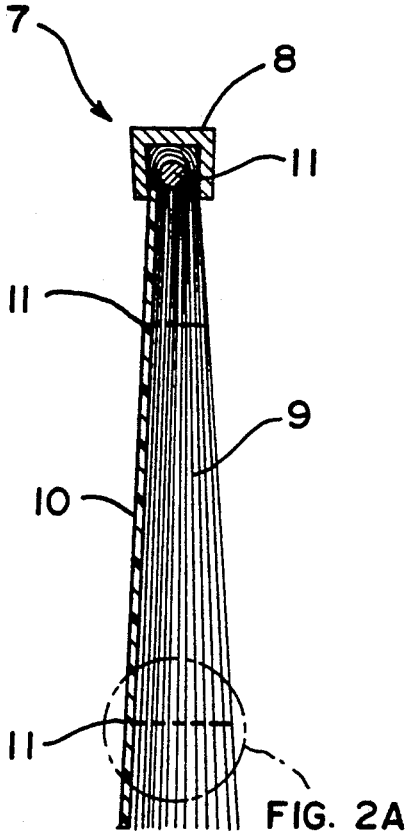
FIG. 2 is a sectional view of the preferred embodiment of the sealing element represented in FIG. 1.
Figure 3:
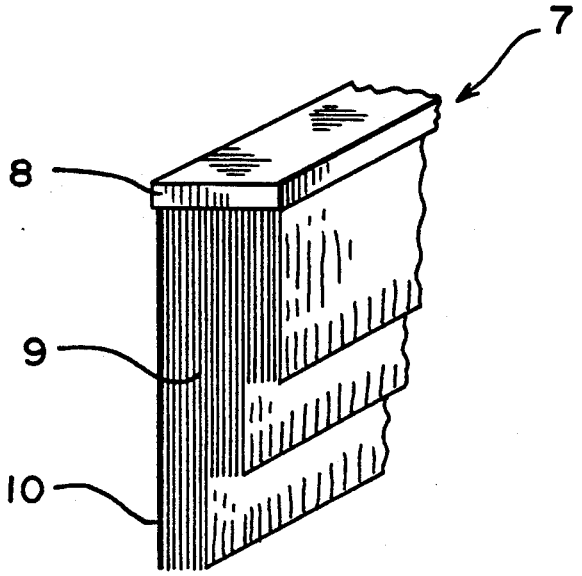
FIG. 3 is a perspective representation of another embodiment of a sealing element according to the invention.
Figure 4:
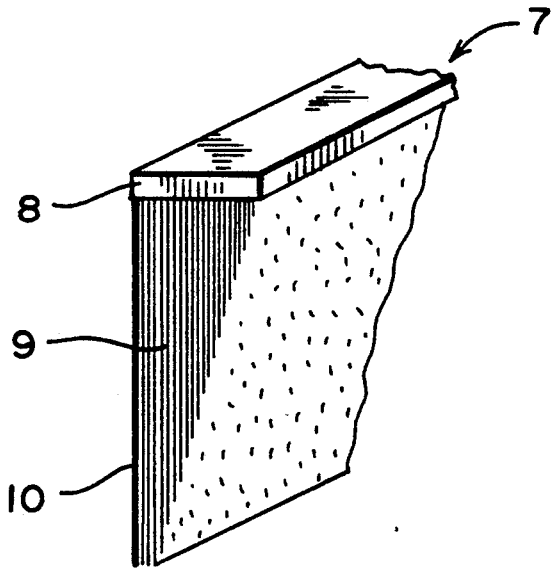
FIG. 4 is view corresponding to FIG. 3 of still another embodiment of a sealing element according to the invention.

In FIGS. 2 to 4, different embodiments for a sealing element 7 are represented. Sealing element 7 is generally designed in a certain width or depth dimension, so that the tightness of the sealing element 7 remains. In addition, brush fibers 9 support protective element 10 placed on the outside of sealing element 7. By the arrangement of a protective element 10, it is possible to reduce the width or depth dimension of a sealing element 7, since protective element 10 increases the tightness of sealing element 7. In this way, material savings are possible. In general, the width or depth dimension of sealing element 7 is about 2 to 6 mm, preferably about 2 to 3 mm; but the dimensions can vary greatly depending on the local conditions.

The sealing element 7, represented in FIGS. 2 to 4, has brush fibers 9 made of plastic, in particular polypropylene or nylon. Brush fibers 9 made of metal and/or of natural fibers would also be possible. The diameter of brush fibers 9 is about 0.1 to 0.4 mm, preferably 0.15 to 0.35 mm. By the selection of varying diameters for brush fibers 9, it is achieved that brush fibers 9 have at least partially varying stiffnesses. Brush fibers 9 located on the edge sides, preferably, are stiff to assure a good attachment of the brush fibers to the roofing material. The good adaptation properties of brush fibers 9 to the roofing material can also be enhanced in that brush fibers 9 are made partially deformed, preferably wavy.

Sealing element 7 can be coupled with the ventilator cap represented in FIG. 1, which exhibits track-like guideways in edge area 3 for that purpose. Carrier part 8 is a metal, U-shaped clamping element and brush fibers 9 are guided around a rod- or wire-shaped holding element 11. The legs of carrier part 8 attach brush fibers 9 in a clamping manner. A plurality of layers of brush fibers 9, placed bordering one another and on top of one another, are provided on the rod- or wire-shaped holding element 11. In this way, any packing density of brush fibers 9 can be achieved in the case of such a sealing element 7. Also, an arrangement of varying lengths of brush fibers 9 is possible so that a stepped or wedge-shaped design of the inside of sealing element 7 is possible. It is essential that a protective element 10 is placed on the outside of sealing element 7, achieving the advantages already described above.

FIGS. 3 and 4 show further possible embodiments of a sealing element 7', 7''. Here, the brush fibers 9 are attached within a carrier part 8' of sealing elements 7', 7''. A protective element 10, again, in the form of a film, is placed, in particular glued, on the outside of the sealing elements 7', 7''. The sealing elements 7', 7'' represented in FIGS. 3 and 4 differ in their inside contour, i.e., the side facing the roof.

The stepped design of the inside of sealing element 7', represented in FIG. 3, makes possible an exact adaptation of brush fibers 9 to sharp-edged transitions. In contrast, the inside of the sealing element 7'' shown in FIG. 4 is wedge-shaped, making possible an exact adaptation of the brush fibers to the roof or the roofing material. Other embodiments for the inside contour of the sealing element are also possible. For example, the inside of sealing element 7'' can be only partially wedge-shaped or the stepped design of sealing element 7' can be made unevenly stepped. Thus, the shape selected will depend on the respective local conditions of use, i.e., the nature of the roof to which the cover 1 is to be applied.

Also, sealing elements 7', 7'' of FIGS. 3 and 4 can be positively or pressurewise connected with the correspondingly designed edge area of the ventilator cap 1. A positive connection could be achieved, especially, by snap locking connections, snap fastener connections, spot or small-area welding or rivet joints or the like. A pressurewise connection is possible by the design of a one-piece or multi-piece sliding guide (cf. FIG. 1) which snugly receives the carrier 8 and frictionally holds it in place. Also, by an additional coupling element, not represented, placed on carrier part 8 of sealing element 7, the coupling with a ventilator cap can be made possible.

By the arrangement of a protective element 10 on the outside of sealing element 7, 7', 7'' that influences the elasticity of brush fibers 9 as little as possible, brush fibers 9 are protected from the effects of weather and the tightness of sealing element 7, 7', 7'' increases. In this way, the advantages of a fine-fiber brush sealing element are maintained.

As protective elements 10, not only are films produced on a polymer base possible but also fiber-type substances or any pastes can be applied in liquid form to brush fibers 9, which then form a solid protective layer on the outside of sealing element 7, 7', 7'' for the protection of brush fibers 9 from the effects of weather are conceivable.

Figure 2A:
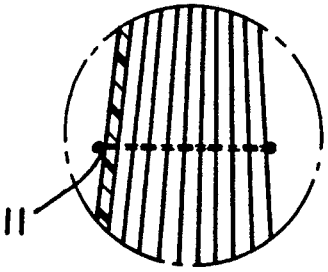
FIG. 2*a* is an enlargement of the encircled detail of FIG. 2.

As noted above, the protective element 10, designed as a film, can be glued to the outside of sealing element 7, 7', 7'', in particular to the "outer brush fibers 9." FIG. 2, especially the enlarged detail portion of FIG. 2*a*, shows another type of connection of protective element 10 with sealing element 7, 7', 7''. Here, namely protective element 10 is sewn into or interwoven with the fibers 9 of the sealing element. A sewing or weaving fiber 11 connects protective element 10 with individual brush fibers 9 of sealing element 7, 7', 7''.

It should be understood that the present invention is not limited to the above-described embodiments, and is susceptible to numerous changes and modifications as known to those skilled in the art. Therefore, this invention is intended to include all such changes and modifications as are encompassed by the scope of the appended claims.

I claim:

1. Ventilator cap for ventilation of a ridge, hip or arris area of a roof, comprising a fastening area, an edge area and an intermediate area connecting the fastening area and the edge area with one another, the intermediate area have air passage openings and the edge area having an elastically flexible sealing element extending over the length of the cap on an underside thereof, and the sealing element being in the form of a fine-fiber brush with a carrier part and a plurality of elastic brush fibers in as flowtight a packing as possible; wherein at least one protective element that influences the elasticity of brush fibers as little as possible is provided on an outer side of sealing element.

2. Ventilator cap according to claim 1, wherein protective element substantially completely covers the outer side of the sealing element.

3. Ventilator cap according to claim 2, wherein the protective element is deformable.

4. Ventilator cap according to claim 3, wherein the protective element is supported by the brush fibers.

5. Ventilator cap according to claim 4, wherein the protective element is in the form of a film.

6. Ventilator cap according to claim 5, wherein the film is formed of a polymer based material.

7. Ventilator cap according to claim 6, wherein the polymer based material is polyester urethane.

8. Ventilator cap according to claim 5, wherein the protective element is glued to the outer side of sealing element.

9. Ventilator cap according to claim 5, wherein the protective element is connected with individual brush fibers of the sealing element by at least one of sewing and interweaving.

10. Ventilator cap according to claim 1, wherein the protective element is impermeable to rain and snow and has at least one of a very good UV resistance, high flexibility at low temperatures and a good resistance to heat aging.

11. Ventilator cap according to claim 1, wherein the brush fibers have at least partially varying stiffnesses.

12. Ventilator cap according to claim 1, wherein the stiffness of the brush fibers is greater at edge sides of the sealing element than at other areas of the sealing element.

13. Ventilator cap according to claim 1, wherein the protective element is deformable.

14. Ventilator cap according to claim 1, wherein the protective element is supported by the brush fibers.

15. Ventilator cap according to claim 1, wherein the protective element is in the form of a film.

16. Ventilator cap according to claim 15, wherein the film is formed of a polymer based material.

17. Ventilator cap according to claim 16, wherein the polymer based material is polyester urethane.

18. Ventilator cap according to claim 1, wherein the protective element is glued to the outer side of sealing element.

19. Ventilator cap according to claim 1, wherein the protective element is connected with individual brush fibers of the sealing element by at least one of sewing and interweaving.

20. Ventilator cap according to claim 1, wherein the cap is made of plastic.

* * * * *